US009708038B2

(12) United States Patent
Imel et al.

(10) Patent No.: US 9,708,038 B2
(45) **Date of Patent: *Jul. 18, 2017**

(54) BOAT ENTRY ASSISTANCE SYSTEM

(71) Applicant: E-Z-DOCK, INC., Monett, MO (US)

(72) Inventors: Dustin Imel, Rocky Comfort, MO (US); David J. Sturtevant, Caro, MI (US)

(73) Assignee: E-Z-DOCK, INC., Monett, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/231,577

(22) Filed: Aug. 8, 2016

(65) Prior Publication Data

US 2016/0347423 A1 Dec. 1, 2016

Related U.S. Application Data

(63) Continuation of application No. 14/645,225, filed on Mar. 11, 2015, which is a continuation of application No. 12/780,473, filed on May 14, 2010, now Pat. No. 9,051,035, which is a continuation-in-part of application No. 12/557,278, filed on Sep. 10, 2009, now Pat. No. 8,256,366.

(60) Provisional application No. 61/192,142, filed on Sep. 16, 2008.

(51) Int. Cl.
*B63C 3/02* (2006.01)
*B63B 27/00* (2006.01)

(52) U.S. Cl.
CPC ..... *B63B 27/00* (2013.01); *B63C 3/02* (2013.01)

(58) Field of Classification Search
CPC ..... B63B 17/00; B63C 1/02; B63C 3/02
USPC ..... 405/1–3; 114/45, 48, 258, 263, 362; 414/139.5, 537, 921
See application file for complete search history.

(56) References Cited

U.S. PATENT DOCUMENTS

| | | | |
|---|---|---|---|
| 1,508,259 | A | 9/1924 | Stafford |
| 2,495,374 | A | 1/1950 | Horn |
| 2,628,879 | A | 2/1953 | Schultz |
| 2,988,753 | A | 6/1961 | Corvelli |
| 3,016,275 | A | 1/1962 | Grant |
| 3,412,702 | A | 11/1968 | Mann |
| 4,363,881 | A | 12/1982 | Smith |
| 4,733,898 | A | 3/1988 | Williams |
| 4,900,217 | A | 2/1990 | Nelson |
| 4,975,991 | A | 12/1990 | Peterson |
| 5,131,342 | A | 7/1992 | Sackett |
| 5,281,055 | A | 1/1994 | Neitzke et al. |

(Continued)

OTHER PUBLICATIONS http://www.goldenboatlifts.com/kayaklaunch.php[Feb. 17, 2016 2:10;18 PM]; Sales@GoldenBoatlifts.com; Golden Boat Lifts,North Fort Myers, FL; 2 pages.

(Continued)

*Primary Examiner* — Sunil Singh
(74) *Attorney, Agent, or Firm* — Polster Lieder Woodruff & Lucchesi L.C.

(57) ABSTRACT

A boat entry assistance system for use with small, manual or paddle or oar powered watercraft (such as canoes and kayaks) is provided with guide rails on either side of a boat positioning unit, such as a boat lift, which can be utilized by a boater to propel his watercraft into the unit. The system includes a specially designed bench system which assists disabled persons with entering and exiting such small watercraft.

12 Claims, 12 Drawing Sheets

(56) References Cited

U.S. PATENT DOCUMENTS

| | | | |
|---|---|---|---|
| 5,317,888 | A | 6/1994 | Towns |
| 5,507,050 | A | 4/1996 | Welner |
| 5,628,274 | A | 5/1997 | Biedenweg et al. |
| 5,823,368 | A | 10/1998 | Burke et al. |
| 5,855,180 | A | 1/1999 | Masters |
| 6,006,687 | A | 12/1999 | Hillman et al. |
| 6,477,968 | B2 | 11/2002 | Powell |
| 6,840,188 | B1 | 1/2005 | Witbeck |
| 7,100,527 | B2 | 9/2006 | Munro |
| 7,182,030 | B2 | 2/2007 | Privette |
| 7,243,608 | B2 | 7/2007 | Knight, Jr. et al. |
| 7,293,522 | B1 | 11/2007 | Elson |
| 7,488,025 | B1 | 2/2009 | Roberson |
| 7,549,692 | B2 | 6/2009 | Washington |
| 7,562,402 | B1 | 7/2009 | Calloway et al. |
| 8,225,734 | B2 | 7/2012 | Huizenga |
| 8,256,366 | B2 | 9/2012 | Imel et al. |
| 8,381,673 | B2 | 2/2013 | Wirsig |
| 8,770,130 | B2 | 7/2014 | Holmes |
| 9,051,035 | B2 * | 6/2015 | Imel ..... B63C 3/02 |
| 2002/0132537 | A1 | 9/2002 | Hey |
| 2005/0172876 | A1 | 8/2005 | Ostreng et al. |
| 2006/0272566 | A1 | 12/2006 | Rueckert |
| 2006/0279182 | A1 | 12/2006 | Chi Ming |
| 2009/0044739 | A1 | 2/2009 | Imel et al. |
| 2009/0044740 | A1 | 2/2009 | Imel et al. |
| 2009/0145345 | A1 | 6/2009 | Newcomb |
| 2009/0295201 | A1 | 12/2009 | Shivers et al. |
| 2012/0152163 | A1 | 6/2012 | Holmes |
| 2012/0199059 | A1 | 8/2012 | Spitzack |
| 2012/0251242 | A1 | 10/2012 | Kollar |

OTHER PUBLICATIONS http://www.kayakdock.com/[Feb. 17, 2016 2:08:19 PM]; sales@kayakdock.com; Kayak Dock, Queenstown, MD 21658 US; 13 pages.

Cellofoam, permalaunch; www.cellofoam.com, 1 page.

www.thedockdoctors.com; Kayak Ladder Lift & Launch; The Dock Doctors' Paddle Products; pp. 12-13.

* cited by examiner

BOAT ENTRY ASSISTANCE SYSTEM

This application is a continuation of co-pending U.S. application Ser. No. 14/645,225 filed Mar. 11, 2015, entitled "Small Watercraft Boatlift" which in turn is a continuation of U.S. application Ser. No. 12/780,473 filed May 14, 2010, entitled "Small Watercraft Boatlift", (now U.S. Pat. No. 9,051,035), which in turn is a continuation-in-part of Ser. No. 12/557,278 filed Sep. 10, 2009, entitled "Small Watercraft Boatlift", (now U.S. Pat. No. 8,256,366), which in turn, claims priority to U.S. Provisional App. No. 61/192,142 filed Sep. 16, 2008 and mailed on Sep. 11, 2008, entitled "Small Watercraft Docking Apparatus To Facilitate Boarding And Disembarking". All of said applications are incorporated herein by reference.

STATEMENT REGARDING FEDERALLY SPONSORED RESEARCH OR DEVELOPMENT

Not Applicable.

BACKGROUND OF THE INVENTION

This disclosure relates generally to docks and/or boatlifts for small watercraft, and in particular to such dock and/or lifts for use manually or paddle powered boats, such as canoes, kayaks, etc.

Boat lifts for small watercraft, such as personal watercraft (PWC's), kayaks, canoes, etc. typically include cradle for the watercraft which is bounded on at least two sides by decking. The boat lift, in turn, is often part of a docking system, which provides lifts for several watercraft. A popular boat lift is sold by EZ Dock, Inc. under the name EZ Port® and EZ Port Max®. However, those who have impaired leg function or are wheel-chair bound find it difficult to board and disembark watercraft when docked in such boat lifts. Additionally, boatlifts, such as the EZ Port and EZ Port Max rely on power from the motor boat motor to propel the watercraft onto the boat lift. It is difficult to product sufficient energy in manually powered (or rowed) watercraft, such as canoes, kayaks, etc. to propel the canoe, kayak, etc. onto the boat lift. Thus, the boater will need to exit or disembark the boat at the dock, and then maneuver the boat around the dock to the boat lift and pull the boat onto the boat lift.

It would therefore be desirable to provide a boat lift for small watercraft which would make it easier for those with impaired leg function or otherwise use a wheel chair to board and disembark from small watercraft. It would also be desirable to provide a boat lift in which oar powered or rowed boats (such as canoes, kayaks, etc.) can be driven or propelled onto a boat lift.

BRIEF SUMMARY OF THE INVENTION

A boat entry assistance system for manually powered (i.e., such as paddle or oar powered) watercraft is provided. The system includes a boat positioning unit for controlled placement of the watercraft adjacent a boat dock. A bench system is mounted on the boat dock and the boat positioning unit includes an elongate passage for positioning the boat or watercraft adjacent the boat dock, and decking on opposite sides of the passage. The system includes an entrance to the passage. A first guide rail is positioned on one side of the passage and a second guide rail is positioned on a second side of the passage opposite the first side and the first and second guide rails each include an approach portion extending rearwardly of the boat positioning unit. Each guide rail includes at least one grab bar extending generally horizontally along the rail, positioned on the guide rail to be generally at a height where a boater sitting in the watercraft is able to reach the grab bar. The bench system of the boat entry assistance system includes a bench positioned adjacent a first side of the boat positioning unit. The bench has an elongate bench body with a front surface, a back surface, side surfaces, a top surface and a bottom surface, which, in combination, delimit an interior of the bench body. The top surface of the bench body defines a generally horizontal seating portion having a front edge and side edges. The front surface of the bench body defines at least one slot spaced below the front edge of the seating portion which opens into the bench's interior. The system includes at least one elongate slide, which has a generally planar top surface generally parallel to the bench body's top surface and elongate sides, and is movable through the at least one slot between a retracted position in which it is substantially received within the bench body's interior and an extended position. The generally planar top surface of the at least one elongate slide is generally spaced vertically below the top surface of the bench body such that it moves in a substantially horizontal plane below a plane defined by the bench body's top surface. The slide is configured such that a user can sit on it and dangle his or her legs over at least one of its edges when in its extended position. The system further includes a support member which supports the at least one elongate slide when in its extended position.

The support member is generally fixed in a position spaced horizontally from the front surface of the bench body when the at least one elongate slide is in its retracted position at a distance no greater than the length of the at least one elongate slide.

The boat entry assistance system of the invention is generally configured so that the at least one elongate slide, when in an extended position, can reach substantially across a boat adjacent to the dock so that a boater can sit on the seat portion and comfortably lower himself or herself into the boat.

In certain aspects of the invention, a boatlift for manually powered (i.e., paddle or oar powered) watercraft is provided. The boatlift is a floating boatlift which comprises an elongate cradle, decking on opposite sides of the cradle, an entrance ramp to the cradle, a first guide rail positioned on one side of the cradle and a second guide rail positioned on a second side of the cradle opposite the first side. The first and second guide rails each comprise an approach portion which extends rearwardly of the boatlift ramp and a boatlift portion extending along the boatlift cradle. Each guide rail further comprises at least one grab bar extending generally horizontally along the rail. The at least one grab bar is positioned on the guide rail to be at a height where a boater sitting in a paddle or oar powered watercraft could reach the grab bar. Additionally, the first and second guide rails are spaced apart from each other a distance sufficient to allow a paddle or oar powered boat to pass therebetween, yet allowing a boater to simultaneously grab the grab bars of both the first and second guide rails so that the boater can utilize the grab rails to move the boat between the guide rails. The first guide rail is an inside guide rail and the second guide rail is an outside guide rail. The outside guide rail is longer than the inside guide rail. Specifically, the boat lift portion of the inside guide rail has an end spaced rearwardly of an end of the boatlift, whereas, the outside guide rail has an end which is substantially even with the forward end of the boat lift.

In an illustrative embodiment, the guide rails each comprise an upper grab bar and a lower grab bar. The lower grab bar extends at least the length of the approach portion of the guide rails, and can extend to the end of the boatlift ramp (i.e., where the ramp and the cradle meet). The upper grab bar extending at least the length of the boatlift portion of the guide rails, and can extend substantially the length of the guide rail.

The boatlift can further include a barrier rail which is associated with the outside guide rail. The barrier rail comprises a horizontal bar spaced above the top bar of the guide rail, and can be mounted to the boatlift decking or to the outside guide rail. If the barrier rail is mounted to the outside guide rail, then the horizontal bar of the barrier rail is higher than it is if the barrier rail is mounted to the boatlift decking. The barrier rail can be independent of or integral with the guide rail.

The boatlift can also be provided with an entrance/exit assist member located proximate a forward end of one of the guide rails. The entrance/exit assist member comprises a pair of opposed legs extending upwardly on opposite sides of the boatlift cradle and a cross-member extending between the legs and over the cradle. The legs are of sufficient height such that a paddle or oar powered watercraft can pass under the cross-member, and whereby the cross-member is at a height to be reachable by a boater sitting in the watercraft.

The boatlift can also be provided with an entrance/exit assist member located proximate a forward end of one of the guide rails. The entrance/exit assist member comprises a pair of opposed legs extending upwardly on opposite sides of the boatlift cradle and a cross-member extending between the legs and over the cradle. The legs are of sufficient height such that a paddle or oar powered watercraft can pass under the cross-member, and whereby the cross-member is at a height to be reachable by a boater sitting in the watercraft.

In addition, the dock to which the boatlift is adjacent can include at least one bench. The bench is positioned to be adjacent the assist member and extends generally perpendicularly to the boatlift. The bench extends from the dock and over an edge of the dock such that a portion of the bench extends over the boatlift cradle. Hence, a boater can sit at the far end of the bench and be positioned over the watercraft. The boater can then use the assist member to help lower himself/herself into the watercraft.

In one illustrative embodiment, the bench comprises a bench body having a front surface, a back surface, side surfaces, a top surface and a bottom surface. The front surface extends generally parallel to an edge of the dock and defines at least one slot. Illustratively, the bench upper surface can include a first outer portion and a second inner portion; wherein the inner portion is generally parallel to and vertically below the outer portion. This provides a bench with two different heights.

The bench body is supported by legs which are mounted to the decking. The legs can comprise an upper portion and a lower portion which are telescopingly connected. The upper portion can be movable relative to the lower portion such that the effective height of the legs (and hence, the height of the bench) can be changed.

The bench body houses at least one extendable/retractable seat member which extends through the at least one slot. The seat member is supported by a support which supports at least one seat member within the bench body to be aligned with the at least one slot so that it may be pulled from the slot to be used. Illustratively, the bench can include two seat members, one being an upper seat member and one being a lower seat member. The front surface of the bench body would include two slots, one slot for each seat member; and two supports within the body to support the two seat members.

Preferably, the seat member includes a grab member (such as a handle or tether) at the end of the seat member that is exposed. To facilitate extension and retraction of the seat member, the support comprises low friction elements; preferably in the form of non-moving guide rails which are made of a low-friction material, such as Teflon.

The seat member extends from the bench and reaches across the boatlift. A seat member support is positioned on a side of the boatlift opposite the bench to support the seat member when extended. The seat member support comprises at least one horizontal surface upon which the end of the seat member rests when it is extended. The seat member can include an arm which extends generally horizontally from the end of the seat member. The arm then engages the at least one generally horizontal surface of the seat member support when the at least one seat member is extended. In an illustrative embodiment, the seat member support comprises a pair of upwardly extending rails and at least one generally horizontal rung extending between the rails. The at least one rung comprising the at least one generally horizontal surface, and the seat member arm engages the at least one rung.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
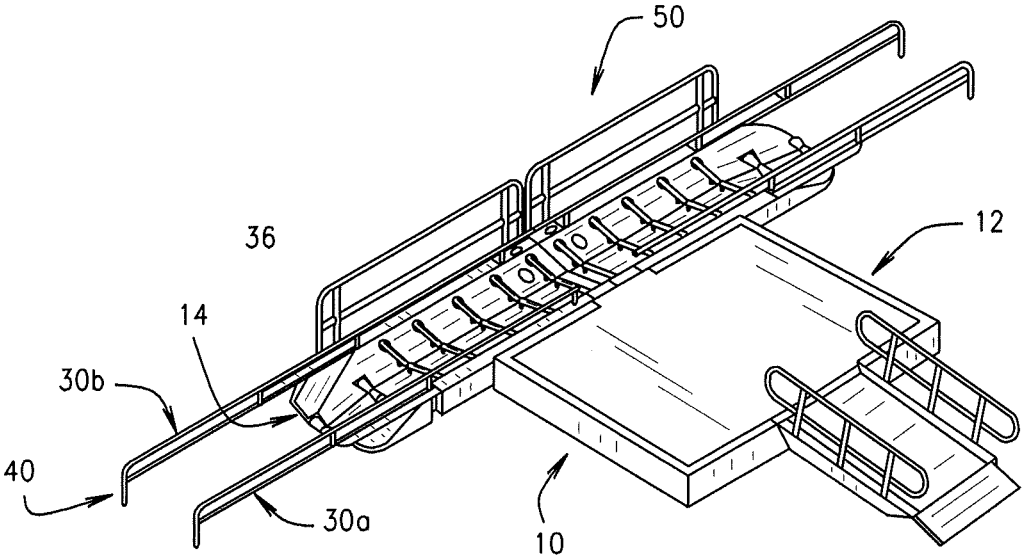
FIG. 1 is a perspective view of a boat lift provided with an illustrative guide rail system.

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

A dock system 10 for small watercraft includes a dock 12 and a boat lift 14. The dock 12 can be a floating dock, such as sold by EZ Dock, and which is comprised of a plurality of dock sections 12*a* which are connected together to form a dock of a desired shape and size. Preferably, the dock system 10 is provided with a gang plank or ramp 13 to facilitate entry onto and exit from the dock 12. A transition member 15 can be provided between the gang plank 13 and the dock 12. Such a dock can be made, for example, in accordance with U.S. Pat. Nos. 5,281,055 and 7,234,608 which are incorporated herein by reference.

Figure 3:
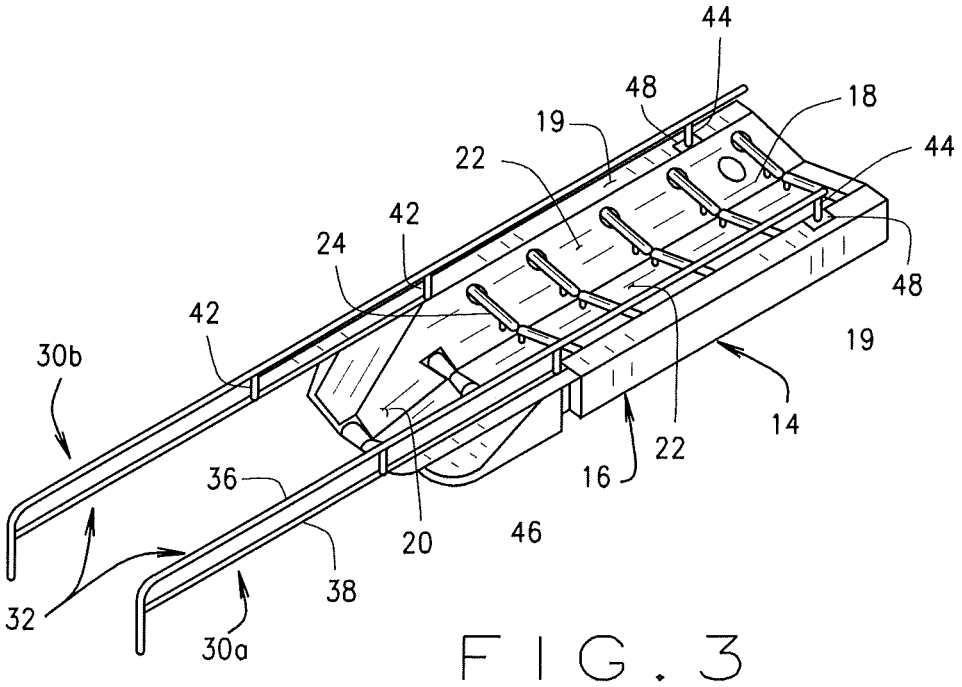
FIG. 3 is a perspective view of one illustrative embodiment of the guide rail system.

The boat lift 14 is secured to the dock 12, in accordance with the docking system 10 from which the dock 12 is made. The boat lift 14 comprises a body 16 having a boat cradle 18 which, as shown, extends the length of the boat lift. A deck 19 extends along the outer edge of the cradle 18 on either side of the cradle 18. The boat lift is preferably a boat lift, such as described in US Pub. No. 20090044740, which is incorporated herein by reference, or which is sold by EZ Dock, Inc. under the name EZ Port Max. An entrance ramp 20 is at one end of the cradle. The cradle 18 has a pair of opposed, inwardly sloping walls 22 with rollers 24 positioned along each wall. The rollers can comprise elongate cylinders 26 (FIG. 3) which extend transversely along the sloping walls of the boat lift cradle 18. These rollers 26 have inner ends that are proximate the center of the cradle, but which are spaced from each other a sufficient distance to enable the rollers to rotate about an axis. Alternatively, the rollers 26 can be football or torpedo-shaped, such as described in US Pub. No. 20090044739, which is incorporated herein by reference.

The boat lift 14 is provided with guide rails 30*a,b* on either side of the cradle 18. The guide rails 30*a,b* are substantially the same. However, as will become apparent, the guide rail 30*b* is slightly longer than the guide rail 30*a*. The guide rail 30*b* can thus be considered an "outside" guide rail which is positioned on the far side of the boat lift 14 from the dock 12; and the guide rail 30*a* can be considered an "inside" guide rail which is on the dock side of the boat lift 14. Although the guide rails 30*a,b* are shown mounted on the right and left sides of the boatlift, respectively (with reference to FIG. 3), the guide rails 30*a,b* could alternatively be mounted on the left and right sides, respectively of the boatlift. The respective placement of the guide rails 30*a,b* depends on which way the boatlift is "facing" or which side of the boatlift is adjacent the dock 12.

The guide rails 30*a,b* are longer than the boat lift 14, and include an approach portion 32 in front of the boat lift ramp 20, and a boat lift section 34. In the outside guide rail 30*b*, the boat lift section of the guide rail extends substantially to the end of the boat lift. The inside guide rail 30*a*, on the other hand, ends short of the end of the boat lift. As seen in FIG. 1, when two boat lifts are connected end-to-end, the shorter inside guide rails provide an pass-through area from the dock 12 through which boaters can pass to access to watercraft.

Figure 2:
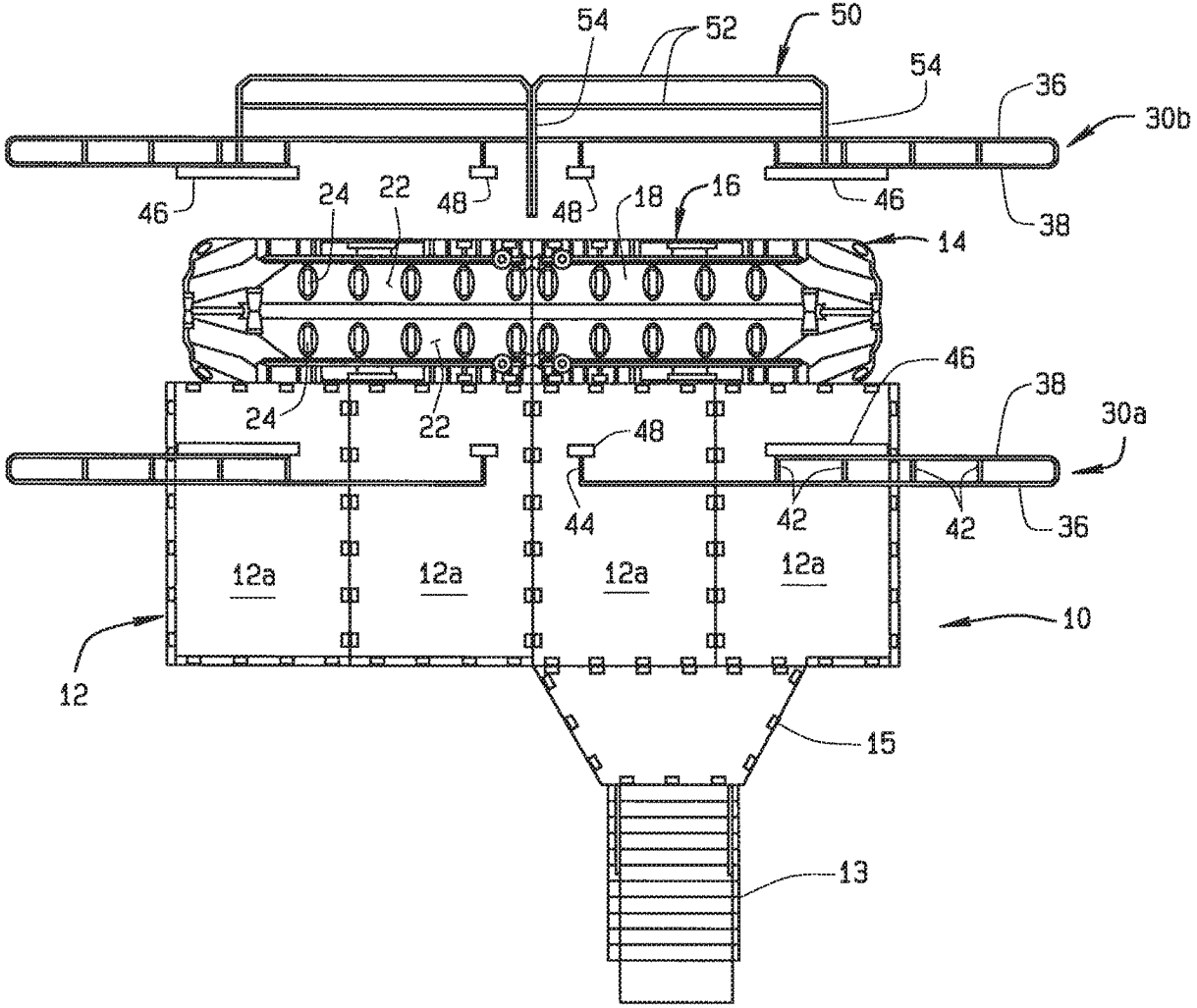
FIG. 2 is a schematic drawing of guide rails of the guide rail system with a plan view of a boat lift and dock.

The guide rails each include a top grab bar 36 which extends substantially the full length of the guide rail 30 and a lower grab bar 38 which extends the length of the approach section 32 of the guide rails. The lower grab bar 38 is essentially level with the boat lift deck 19, and extends substantially the length of the on-ramp section to the cradle 18. The guide rail additionally can include a front pole 40 at the front end of the guide rail 30 to which both the upper and lower grab bars are connected. (FIG. 1) Alternatively, as seen in FIG. 2, the front end of the guide rail can simply be closed by a section of the bar. In this instance, the grab bars 36 and 38 can be formed from a single long section of tubing which is bent to form the two grab bars. Connector posts 42 extend between the upper and lower grab bars 36, 38, and an end post 44 is positioned near the end of the guide rail. On the inside guide rail 30*a*, the top grab bar 36 ends at the end post 44, whereas, on the outside guide rail 30*b*, the top grab bar extends beyond the end post 44. Lastly, the guide rails 30*a,b* include a mounting plate 46 which extends between the two connector posts 42, and a mounting plate 48 at the bottom of the post 44 to facilitate mounting of the guide rail to the boat lift 14. The mounting plates 46 and 48 are generally perpendicular to the posts 42 and 44, such that when the mounting plates are secured to the deck portion 19 of the boatlift 14, the guide rails 30*a,b* will be generally perpendicular to the boatlift (and will be generally vertical).

Figure 4A:
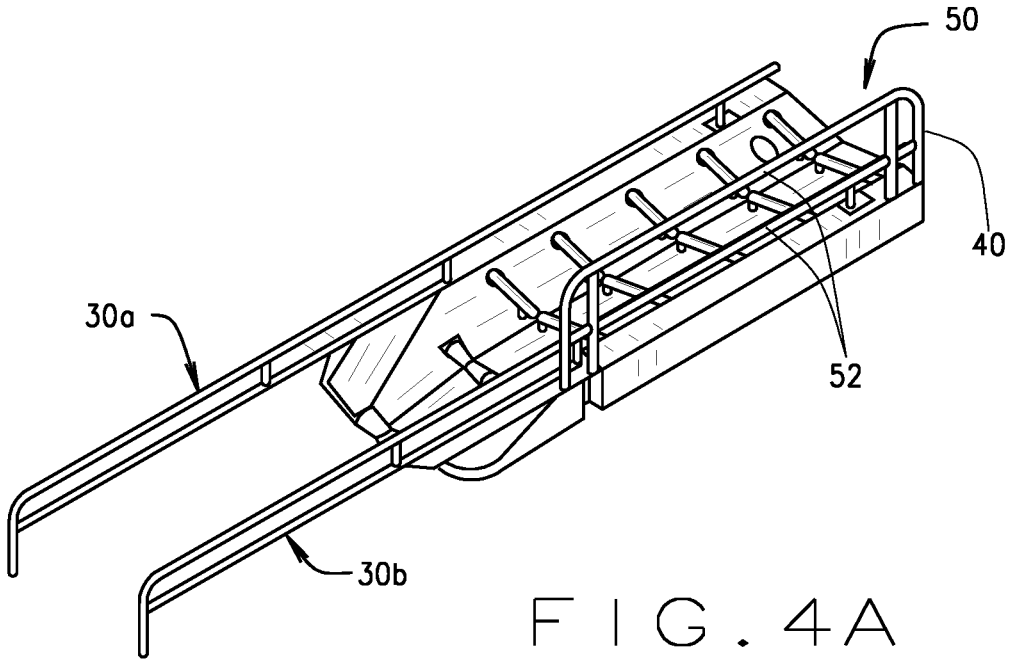
FIGS. 4*a,b* are perspective view of the guide rail system provided with barrier rails, the two figures showing the barrier rail mounted in two different positions relative to the guide rails.
Figure 4B:
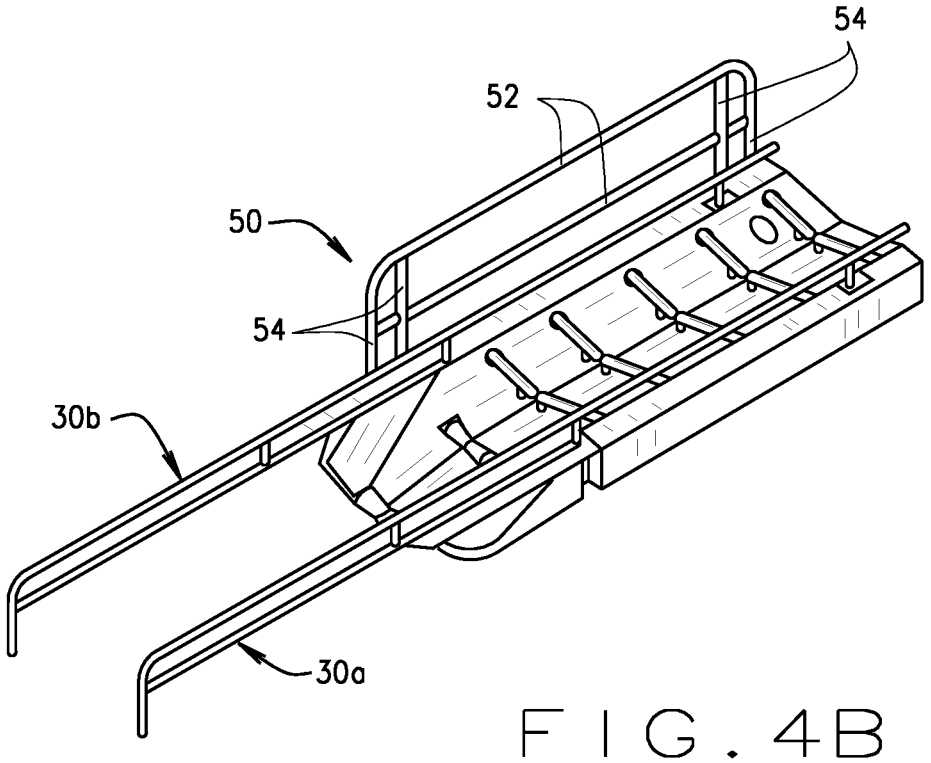

As shown in FIGS. 1 and 4*a,b*, a barrier rail 50 can be provided. The barrier rail 50 includes a pair of vertically spaced apart, horizontally extending bars 52 which are connected, at their opposite ends, by vertical posts 54. The barrier rail 50 extends the length of the boatlift cradle 18 (or generally from the end of the boatlift ramp 20 to the opposite end of the boatlift 14. As shown in FIG. 4*a*, the barrier rail 50 can be mounted directly to the boat lift, in which case, the barrier rail lower bar is generally level with the upper grab bar of the guide rail approach portion. In this instance, this lower bar of the barrier rail could operate as a continuation of the lower grab bar. Alternatively, as shown in FIG. 4*b*, the barrier rail can be mounted to the guide rail 30, such that the bottom of the vertical posts 54 of the barrier rail are approximately level with the top bar of the guide rail. Here, the barrier rail is described as being separate from the guide rail. However, the barrier rail could be formed with, or as a part of, the guide rail. As seen, the barrier rail is associated with the outside guiderail 30*b*.

Figure 5:
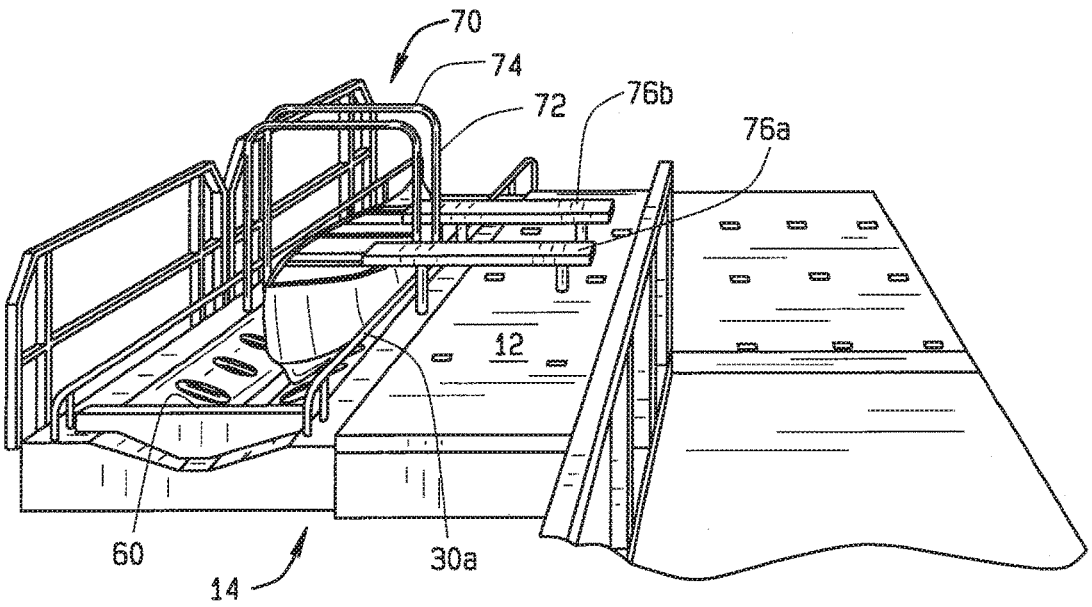
FIGS. 5 and 6 are front and side perspective views of the guide rail system provided with assist members to facilitate entry into and exit from small watercraft and benches on the dock to facilitate use of the assist members.

As shown in FIG. 1, two boat lifts can be connected in tandem to form a single boat lift that is open at both ends. In this instance, one end of the boat lift serves as an entrance, and the opposite end serves as an exit. Alternatively, if the boatlift does not include a ramp at its forward end, as seen in FIG. 5, the boatlift can be provided with a stop 60 to prevent the watercraft from being propelled forwardly off the end of the boatlift. The stop 60 can simply be a bar which extends across the forward end of the boatlift between the inside and outside guide rails 30*a,b*, as seen in FIG. 5. Alternatively, the stop 60 can comprise a bow stop, as disclosed in the above noted US Pub. No. 20090044740, which is incorporated herein by reference.

When the guide rails 30 are mounted to the boat lift 14, the lower grab bars 38 of the approach portion 32 are approximately at the level of the canoe, kayak, etc., so that they can easily be grasped by a boater sitting in the canoe, kayak, etc. Further, the two guide rails are spaced apart a distance which will allow the boat to pass between the rails 30, yet which will allow the boater to grab both rails at the same time. Hence, by grabbing the lower grab bars 38 of the approach portion of the guide rails 30, the boater can propel his/her boat forward with sufficient force to drive the watercraft onto the on-ramp of the boatlift. By grabbing a forward section of the grab bars 36, 38, the boater can continue to propel his/her boat along the boatlift until the watercraft (i.e., canoe, kayak, etc.) is fully on the boatlift. As can be appreciated, as the watercraft is propelled onto the boatlift, the level of the watercraft, and hence, the boater, will be raised. Hence, as the boater moves the watercraft along the boatlift, the boater can change from initially using the lower grab bars 38 to using the upper grab bars 36 of the guide rails 30. When a boater desires to launch the watercraft, the boater need only get into the watercraft, and using the guide rails 30*a,b*, propels the boat off the boatlift. In the embodiment of FIG. 1 (which has ramps at both ends of the boatlift) the boater can go forward, whereas in the embodiment of FIG. 5 (which has a stop extending across the forward end of the boatlift), the boater will need to go backwards to exit the boat lift. In either case, the rollers facilitate moving the watercraft along the boat lift, such that moving the watercraft along the boatlift is not unduly strenuous.

Figure 6:
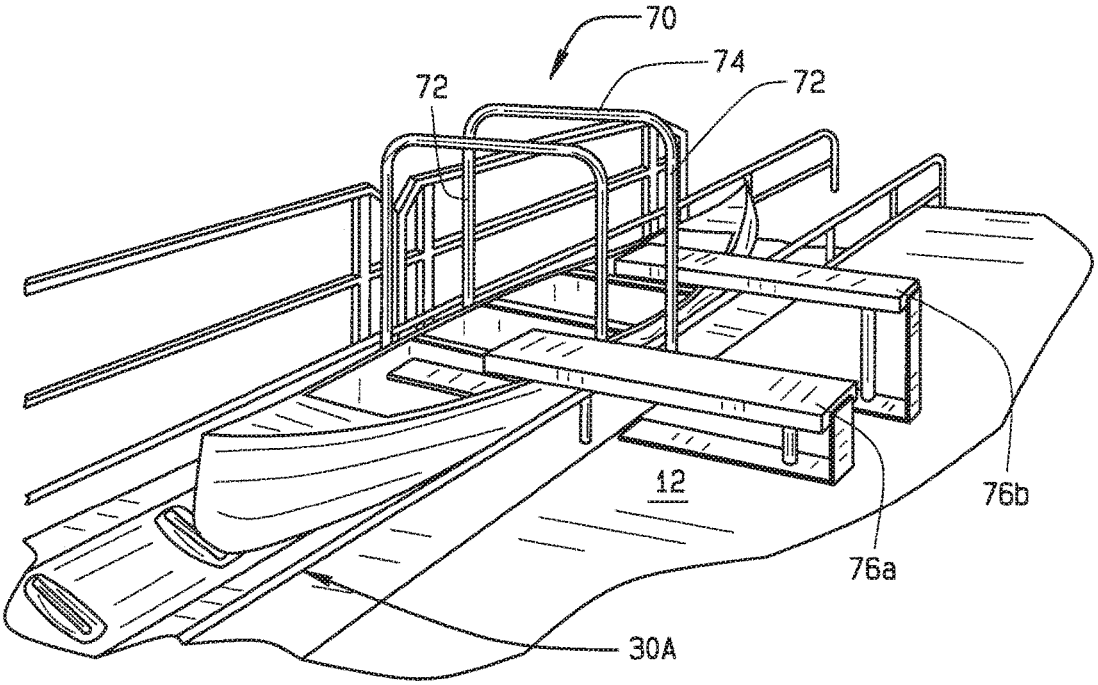

The embodiment of FIGS. 1-4*b* works well for able bodied boaters. However, it does not facilitate boaters with impaired leg function, are in a wheel chair, or otherwise have difficulty in getting into and out of small watercraft. In FIGS. 5 and 6, the boatlift is provided with an entrance/exit assist member 70 comprised of vertical legs 72 and a cross-member 74 extending between the legs 72. The legs 72 extend upwardly from the boatlift on opposite sides of the boatlift cradle 18, and the cross-member 74 extends over the cradle 18. The assist member 70 is positioned at the end of the inside guide rail 30*a*. Thus, in FIGS. 5 and 6, where two boatlifts are interconnected, and the inside guide rails form a pass through area, the assist members 70 are at this pass-through area. As seen, a boat can pass under the assist members 70. The assist members 70 are sized such that the cross-member 74 is at a height which will allow for a boater sitting on a bench in the boat to reach up and grab the cross-member 74.

The dock is further provided with a pair of benches 76*a,b* positioned adjacent the assist members 70. The benches 76*a,b* extend across a portion of the dock 12 so that the benches can be used by people on the dock 12. In addition, the benches 76*a,b* extend past the edge of the dock and over the decking of the boatlift, such that the edge of the benches are over the gunwales of the boat. In FIGS. 5 and 6, the benches 76*a,b* are of different heights, with the bench 76*b* being higher than the bench 76*a*. This allows for the benches to accommodate people of different abilities. For example, one of the benches may be easier for someone in a wheelchair to use, while the other bench may be easier for someone who walks, but otherwise needs assistance in getting into and out of the watercraft.

To use the entry/exit assist, the boat is positioned at the pass-through between the inside guide rails 30*a* with the boat seats generally beneath the assist members 70. With the boat in position, a boater can seat himself/herself on one of the benches 76*a,b* and slide over to the edge of the bench. By holding on to the cross-member 74, the boater can lower himself/herself from the bench 76*a,b* to the boat seat.

Figure 7:
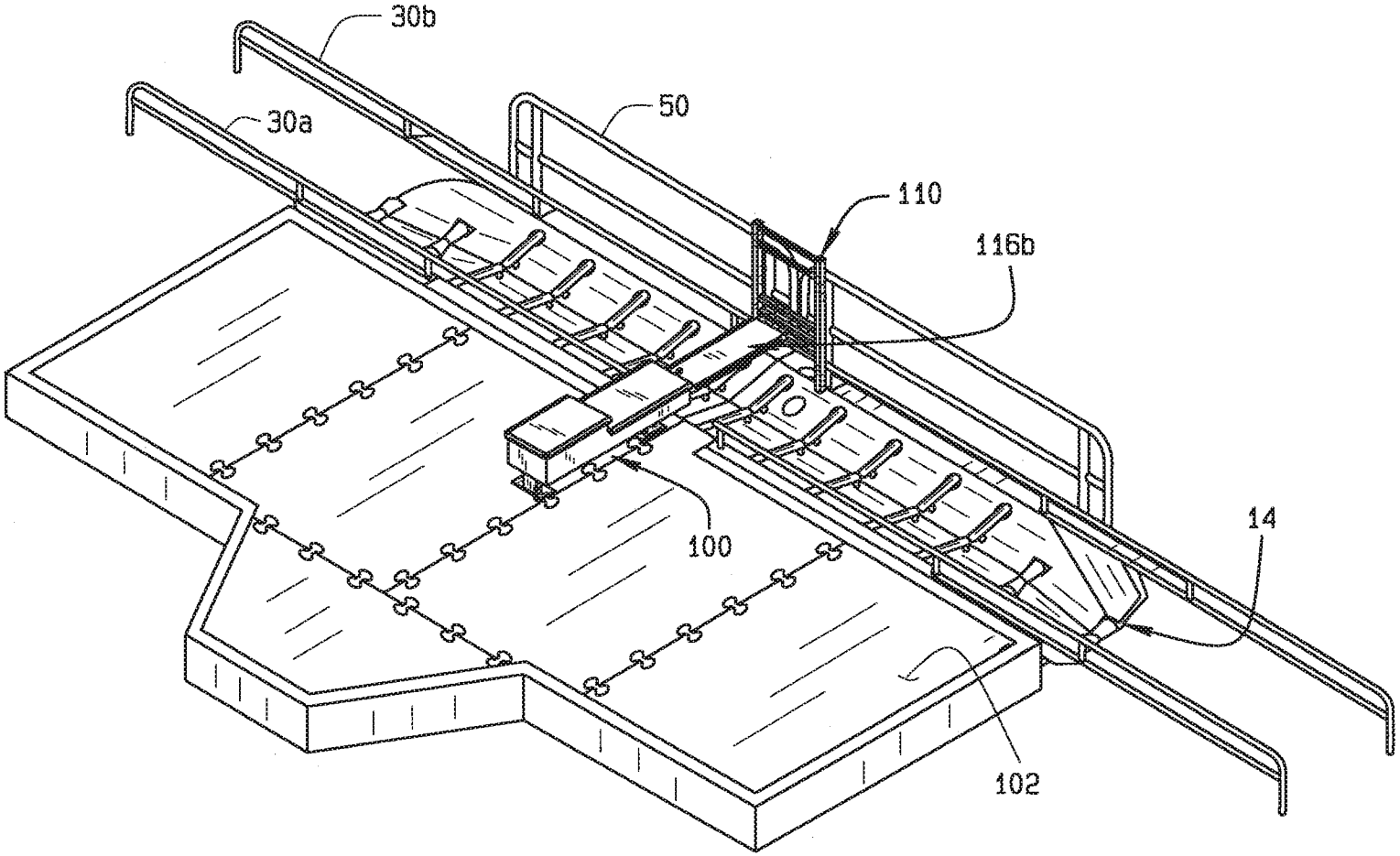
FIG. 7 is a perspective view of a deck fitted with the guide rail system and a second embodiment of a deck bench, the deck bench facilitating embarking and disembarking of disabled boaters.
Figure 8:
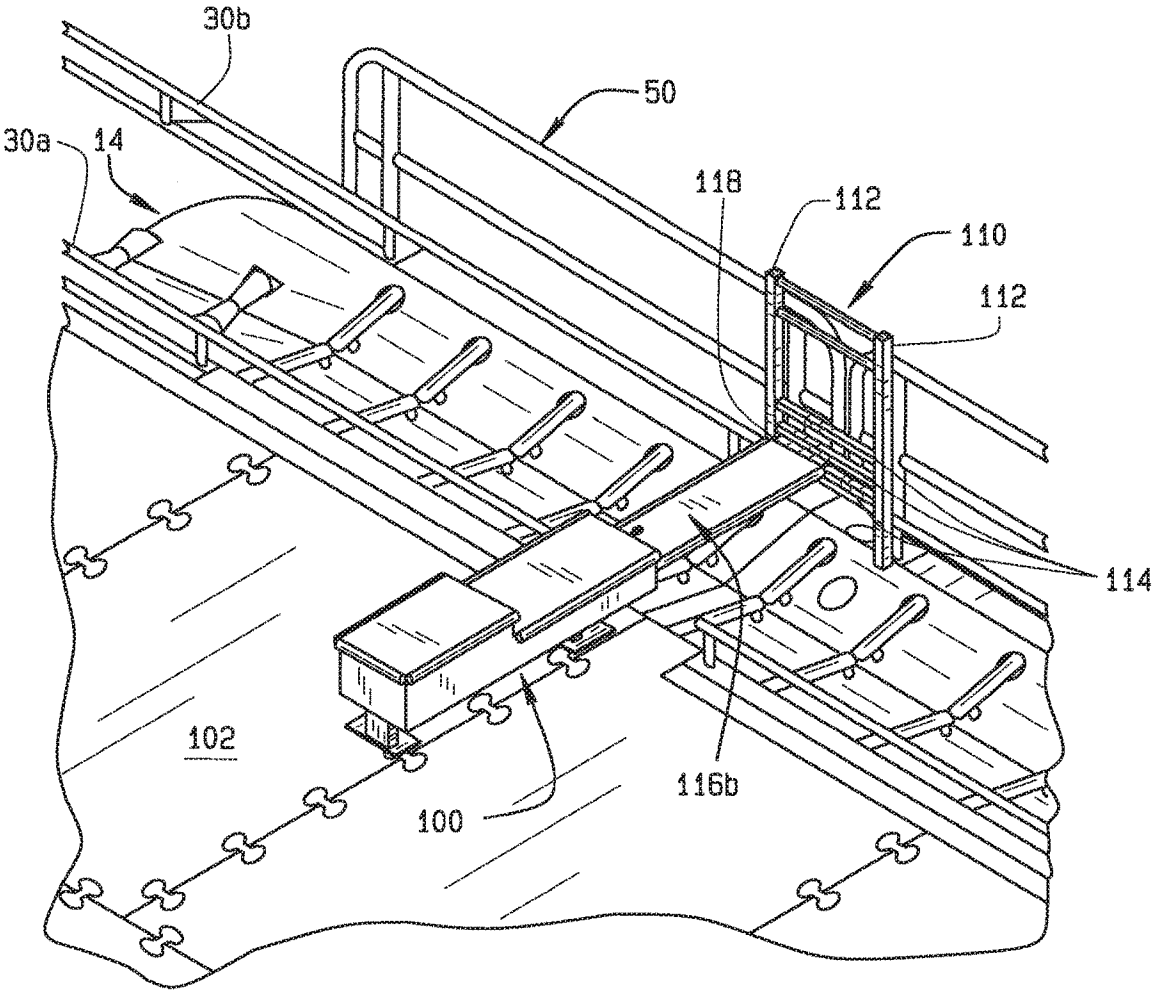
FIG. 8 is an enlarged view of the deck bench and guide rail system.
Figure 9:
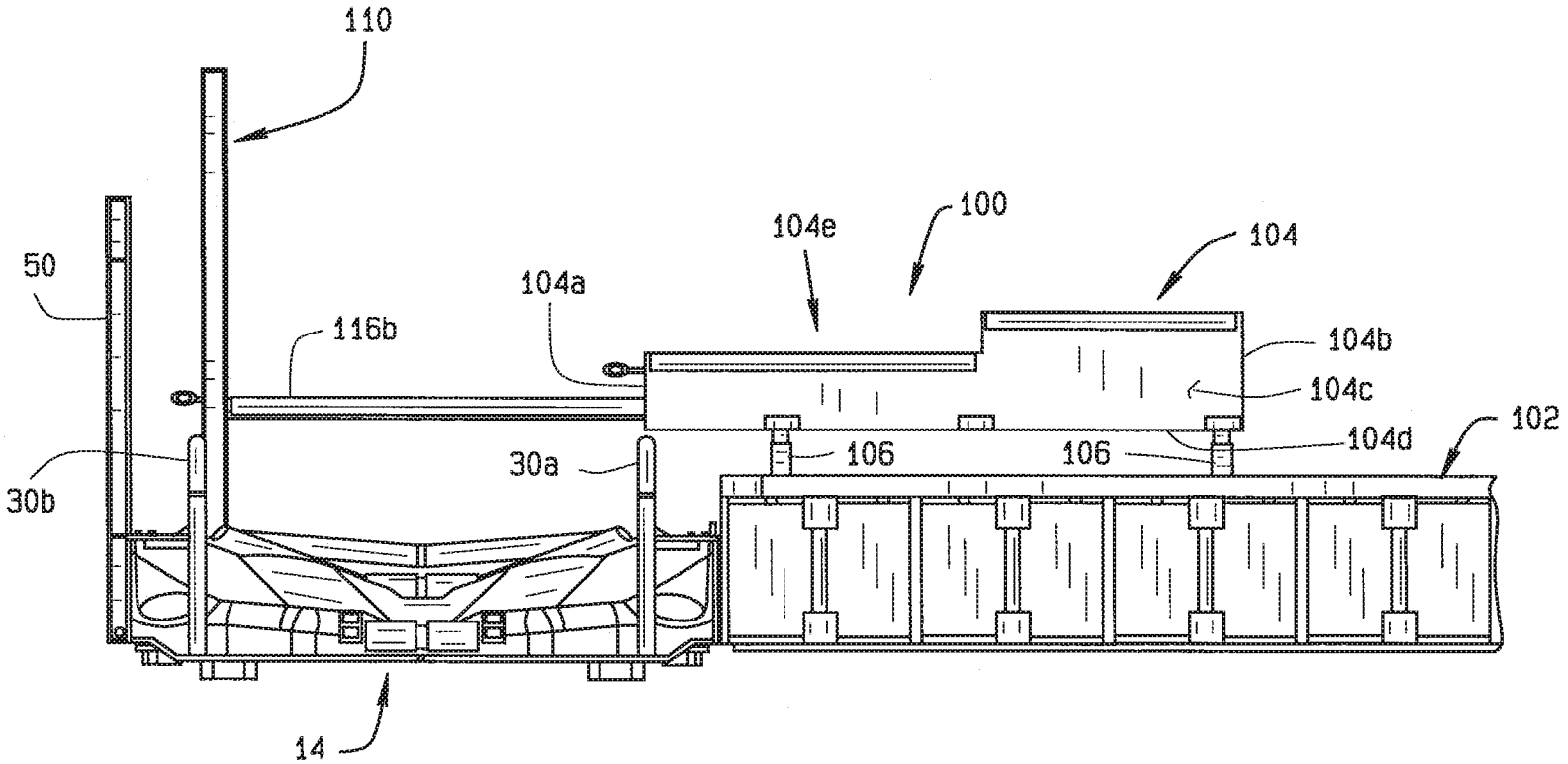
FIG. 9 is an end view of the guide rail system with the deck bench of FIG. 8 showing a seat member of the deck bench in a fully extended position.
Figure 10:
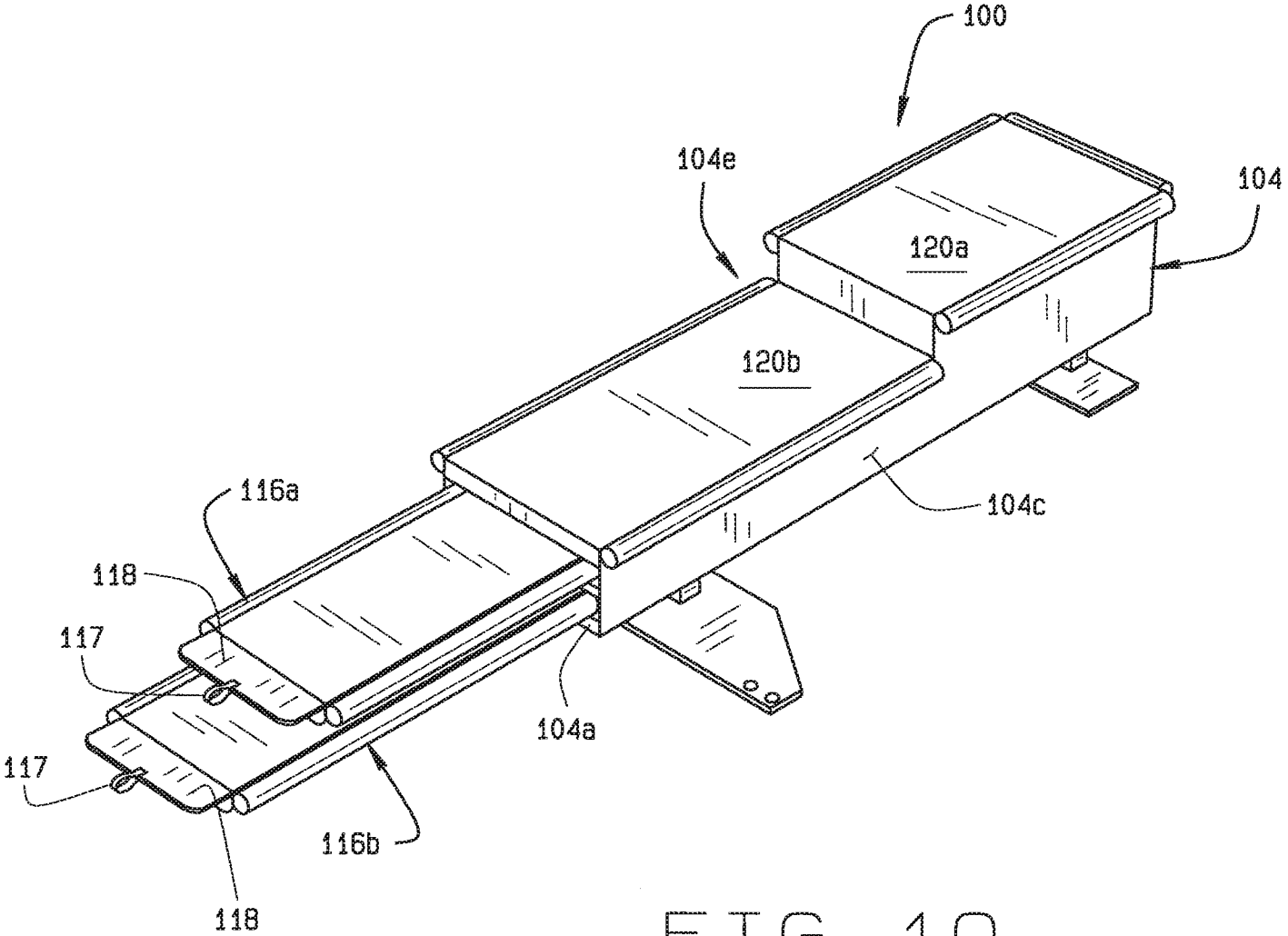
FIG. 10 is a perspective view of the bench, with both seat members extended for purposes of illustration.
Figure 11:
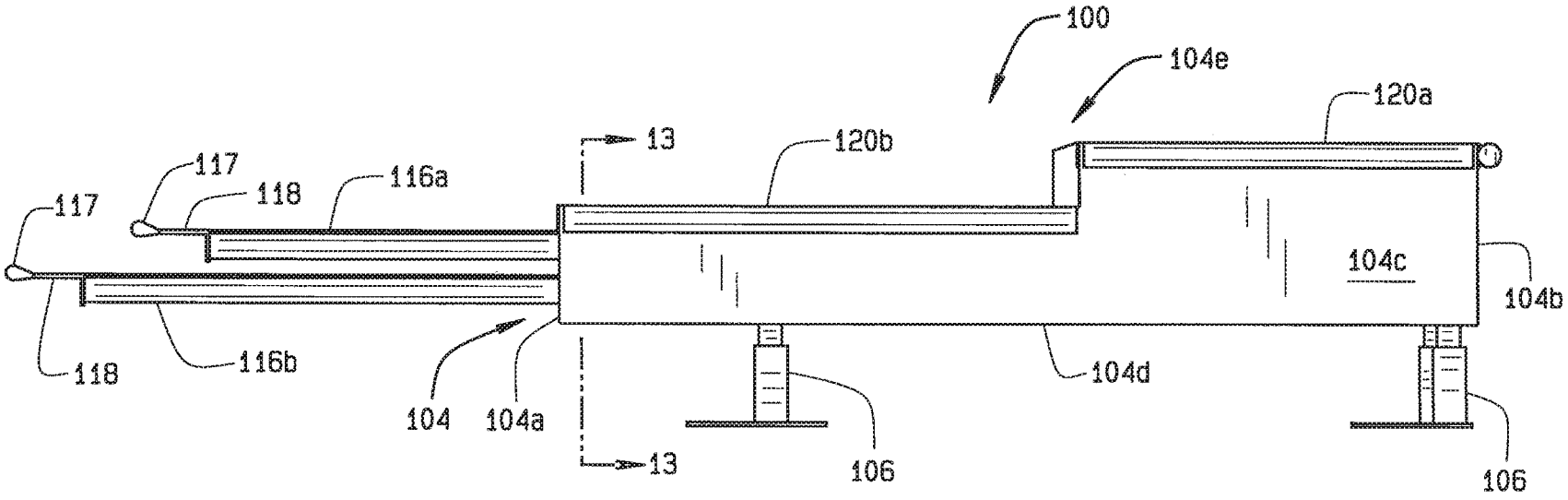
FIG. 11 is a side elevational view of the bench.

An alternative bench 100 is shown generally in FIGS. 7-9 mounted on a deck platform 102. The bench 100 includes an elongate body 104 defining front 104*a*, back 104*b*, sides 104*c*, bottom 104*d* and top 104*e* surfaces. A pair of legs 106 extend downwardly from the body 104 to support the bench body 104 above the surface of a deck 102. Upper and lower slots 105*a,b* are formed in the bench body front surface 104*a*. As best seen in FIG. 9, the bench body 104 extends beyond the edge of the deck platform 102, such that the front surface 104*a* of the bench body 104 is approximately flush with the inside guide rail 30*a*.

A seat member support 110 in the form of a ladder is positioned on the opposite side of the boatlift 14 from the bench 100. The ladder 110 includes a pair of side rails 112 which extend up from the surface of the boat lift 14 and a plurality of rungs 114 extending between the rails 112. As will be described in more detail below, the bench 100 includes extendable/retractable seat members 116*a,b* which extend across the boatlift 14 from the front surface 104*a* of the bench 100 to be supported by one of the rungs 114 of the ladder 110. The seat members, as seen, define a generally planer top surface having elongate side edges. As described below, the seat members are configured so that a boater can sit on the seat member (when it is extended) to lower him/herself into a watercraft. Conversely, the boater can raise him/herself out of the watercraft to then sit on the extended seat member.

The seat members 116*a,b* are stored within the bench body 104, and extend and retract through the slots 105*a,b* in the bench body front surface 104*a*. The seat members 116*a,b* are accessible through the slots 105*a,b* when the seat members are stored in the bench body. The seat members can be retracted fully into the body (and be reached through the slots) or the seat member can protrude slightly from the slot when the seat member is in a retracted position. As will be described below, when extended, the seat members 116*a,b* reach or extend across the boatlift 14 to enable a disabled boater (such as one who does not have use of his/her legs) to get in and get out of a small boat, such as a kayak or a canoe. To facilitate extending of the seat members 116*a,b*, each seat member includes a grip 117. The grips 117 are shown as flexible loops, but could comprise handles, pull rods, etc. The seat members also include arms 118 at the end of each seat member. The arms 118 extend from the seat members such that they are generally flush or level with the top surface of the seat members. The arms 118 rest on the rungs 114 of the ladder 110 when the seat members are extended. The grips 117 are illustratively mounted to the ends of the arms 118. As can be appreciated, the arms 118, and the connection between the arms 118 and the seat members 116*a,b* are sufficiently robust to support a person on the seat member with the seat member extended.

The bench 100 is shown in more detail in FIGS. 10-14. The bench top surface 104*e* includes a first portion 120*a* and a second portion 120*b*. The second portion 120*b* extends over the edge of the deck, and the first portion 120*a* extends inwardly from the inner end of the second portion 120*b*. As seen, the second portion 120*b* is below the first portion 120*a*. Preferably, the bench top second portion 120*b* is no more than about 5" (about 12.7 cm) below the bench top first portion 120*a*. As is clear from the drawings, the bench top second portion is spaced below the first portion, and forward of the first portion, such that both the first and second portion are accessible at the same time. The bench 100 is designed for use by persons who do not have the use of their legs (such as paraplegics). It has been determined that the average maximum height a person can raise him or herself off a surface using his or her arms is about 5". Hence, the bench top first surface is about 5" above the bench top second surface.

Wheel chairs have one of two typical seat heights. Hence, the different heights of the bench top surface enable users of wheel chairs with either seat height to more easily transfer from their wheel chairs to the bench. Thus, one who uses a wheel chair having a higher seat height can transfer from his/her wheel chair to the higher first surface 120*a* of the bench top 104*e*; and one who uses a wheel chair having a lower seat height can transfer from his/her wheel chair to the lower second surface 120*b* of the bench top 104*e*. Hence, the difference in height between the two benches is designed to enable a disabled individual to elevate himself or herself from the lower bench top 120*b* to the upper bench top 120*a* (or vice versa), just by pushing up with his/her arms.

Figure 12:
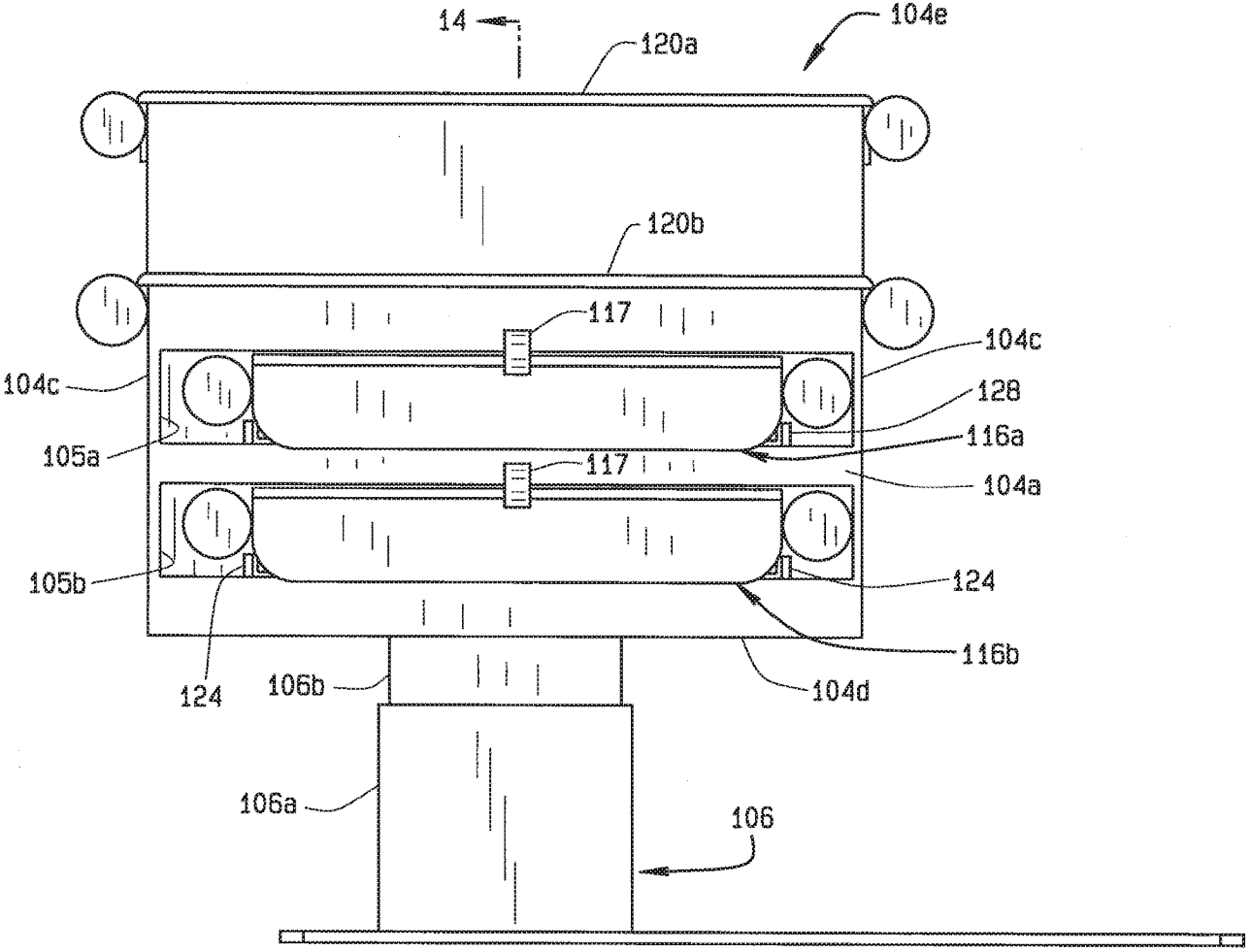
FIG. 12 is an end elevational view of the bench.
Figure 13:
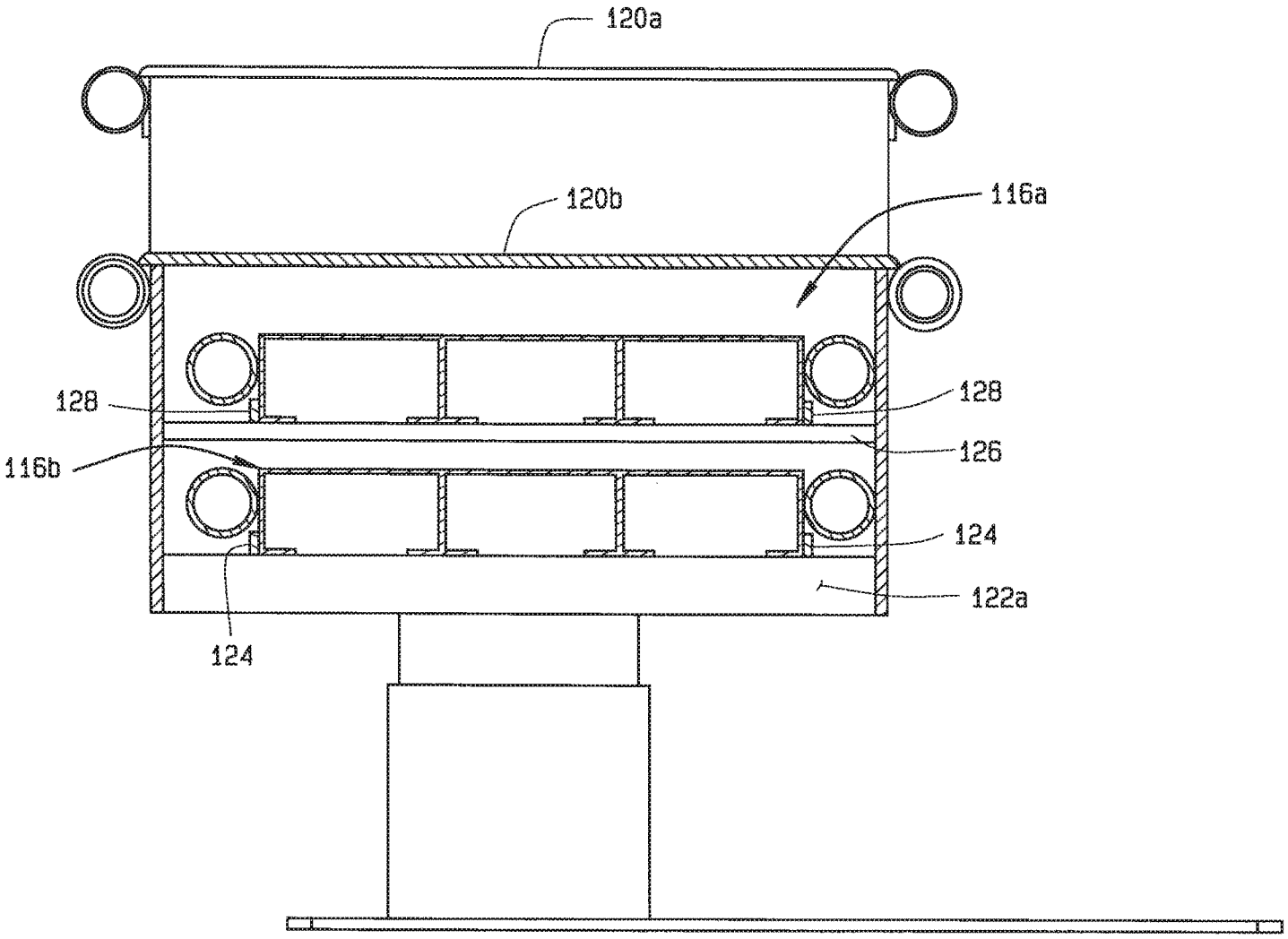
FIG. 13 is a cross-sectional view of the bench taken along line 13-13 of FIG. 11.
Figure 14:
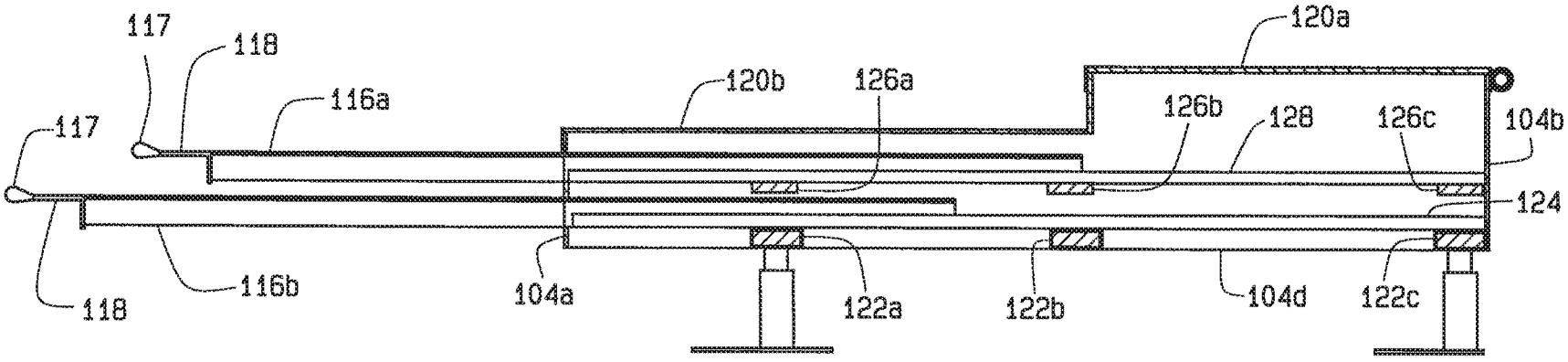
FIG. 14 is a cross-sectional view of the bench taken along line 14-14 of FIG. 12.

Turning to FIGS. 12-14, internally, the bench body 104 includes lower cross-members 122*a-c* which are spaced apart, and extend across, the body bottom surface 104*d*. As seen in the drawings, the lower cross-members extend substantially the full width of the bench body, between the opposite side surfaces 104*c*. The lower seat member 116*b* rests (and slides) on the lower cross-members 122*a-c*. Hence, the upper surface of the cross-members 122*a-c* is substantially even or flush with the lower edge of the lower slot 105*b* in the body front surface 104*c*. Rails 124 are positioned on either side of the seat member 116*b* to maintain alignment of the seat member 116*b* within the bench body. The upper seat member 116*a* is supported by (and slides on) cross-members 126*a-c* which extend the width of the bench body between the side surface 104*c*. The upper cross-members 126*a-c* can be fixed to the side surfaces 104*c*. To maintain the upper seat member 116*a* in vertical alignment upper slot 105*a* of the front surface, the upper surface of the cross-members 126*a-c* is substantially even or flush with the lower edge of the upper slot 105*a* in the body front surface 104*c*. Rails 128 are mounted to the top of the cross-members on either side of the seat member 116*a* maintain the horizontal position of the seat member 116*a* relative to the body and the front upper slot 105*a*. To facilitate sliding of the seat members 116*a,b*, the supports and rails are preferably made from a low friction material, such as Teflon.

Although supports (in the form of cross-members) and rails are shown to maintain the vertical and horizontal position of the seat members 116*a,b* in the bench body 104, the seat members could be supported by other means. For example, the seat members could be supported by rails, which, could be formed from L-beams, for example. Such L-beams would also be made from a low friction material, such as Teflon. The use of a low friction material avoids the use of moving parts, which may have a shortened life in marine environments. However, if desired, cross-members 122*a-c* and 126*a-c* could be replaced with rollers. Alternatively, spaced apart bearing assemblies could be provided on which the seat members 116*a,b* slide.

The use of low friction guides, whether the low friction guide be made from a low friction material or be comprised of rollers or bearing assemblies, allows for the seat members to be extended from, and retracted into, the bench body easily. This is relatively important, because when exiting a water craft, the boater will be below, and in front of the seat members, and hence, will have to reach up to grasp the seat member, and will have to extend the seat member behind the boater.

In use, when a boater is entering a kayak or canoe that is positioned in the boat lift 14, the boater will first extend one of the two seat members 116*a,b* until the arm 118 of the seat member is positioned on a rung 114 of the ladder 110. With the seat member supported at one end by the bench 104 and at the opposite end by the ladder 110, the boater can slide out over the kayak or canoe on the extended seat member 116*a,b*. Once the boater is over the seat of the kayak or canoe, the boater can lower himself/herself into the boat.

To exit a small boat, the boater will approach the boat lift 14, and position the small boat on the boat lift such that the boater is slightly in front of the bench 100 and ladder 110. With the boater so positioned, the boater can reach up and pull out the seat member. The seat member will extend behind the boater. When the seat member is positioned, the boater can raise himself/herself up onto the extended seat member 116*a,b*. Once the boater is on the seat member, the boater can then scoot over towards the bench body 104.

As noted there are two seat members 116*a,b*. Only one seat member will be extended at a time. The seat member that is extended will depend on the size of the boat the boater is entering or exiting. If the boat seat is low, the boater may use the lower seat member 116*b*. If the boat seat is higher, the boater may use the upper seat member 116*a*.

To add greater flexibility to the use of the bench 100, the legs 106 are telescoping legs. The legs comprise a lower section 106*a* and an upper section 106*b*. Illustratively, the upper leg section is received in the lower leg section, but this could be reversed. The leg sections can include a series of discrete holes and pins which extend through the holes when aligned. Any other alternative structure of changing the effective length of the legs can be used as well. Preferably, the legs allow for a change in effective length of about 5".

As various changes could be made in the above constructions without departing from the scope of the invention, it is intended that all matter contained in the above description or shown in the accompanying drawings shall be interpreted as illustrative and not in a limiting sense. For example, although the inside guide rail 30*a* is described to be mounted or secured to the boatlift, the inside guide rail 30*a* could be secured to the edge of the dock 12. Although the guide rails include upper and lower grab bars, the guide rails could each be provided with a single grab bar. In this case, the single grab bar would preferably be contoured, such that the section of the grab bar in the approach portion of the guide rail is below the section of the grab bar in the boatlift portion of the guide rail. These examples are merely illustrative.

What is claimed:

1. An entry assistance system for paddle or oar powered watercraft comprising:

a positioning unit for controlled placement of said paddle or oar powered watercraft adjacent a dock;

a bench system mounted on said dock;

said positioning unit comprising an elongate passage for positioning said paddle or oar powered watercraft adjacent said dock, and decking on opposite sides of said elongate passage;

an entrance to said elongate passage;

at least a first guide rail positioned on a first side of said passage and at least a second guide rail positioned on a second side of said elongate passage opposite said first side, said at least first and second guide rails each comprising an approach portion extending rearwardly of said positioning unit;

each said first and second guide rails further comprising at least one grab bar extending generally horizontally along said first and second guide rails, said at least one grab bar being positioned on said first and second guide rails to be generally at a height where a user sitting in a paddle or oar powered watercraft could reach said at least one grab bar;

said bench system comprising:

a bench positioned adjacent a first side of said positioning unit; said bench having an elongate bench body having a front surface, a back surface, side surfaces, a top surface and a bottom surface which in combination delimit an interior of said elongate bench body, said top surface of said bench body defining a generally horizontal seating portion having a front edge and side edges;

said front surface of said elongate bench body defining at least one slot spaced below said front edge of said generally horizontal seating portion and which opens into said interior, and at least one elongate slide having a generally planar top surface which is generally parallel to said elongate bench body top surface and elongate sides, said at least one elongate slide being movable through said at least one slot between a retracted position in which said at least one elongate slide is substantially received within said bench body interior and an extended position;

said generally planar top surface of said at least one elongate slide being spaced vertically below said top surface of said bench body such that said at least one elongate slide moves in a substantially horizontal plane below a plane defined by said elongate bench body top surface, said at least one elongate slide being configured such that a user can sit on said at least one elongate slide and dangle legs over at least one of said elongate sides of said at least one elongate slide when in its said extended position; and a support member that supports said at least one elongate slide when in its extended position.

2. The entry assistance system of claim 1 wherein said elongate passage for positioning said paddle or oar powered watercraft adjacent said dock further comprises an elongate cradle.

3. The entry assistance system of claim 2 wherein said elongate cradle further comprises a boatlift.

4. The entry assistance system of claim 2 further comprising a ramp located at said entrance.

5. The entry assistance system of claim 1 wherein said at least one elongate slide further comprises at least a first elongate slide and a second elongate slide, said second elongate slide being below said first elongate slide; each of said at least first and second elongate slides having a generally planar top surface which is generally parallel to said elongate bench body top surface and elongate sides; and wherein said at least one slot further comprises at least an upper slot and a lower slot; said first elongate slide being extendable and retractable through said upper slot; and said second elongate slide being extendable and retractable through said lower slot; said first and second elongate slides being generally parallel to each other and each of said at least first and second elongate slides being translationally supported in said elongate bench body interior in alignment with said upper slot and lower slot, respectively; said at least first and second elongate slides being movable independently of each other through said upper slot and lower slot, respectively between a retracted position in which said at least first and second elongate slides are substantially received within said elongate bench body interior and an extended position; said generally planar top surface of said at least first and second elongate slides being spaced vertically below said top surface of elongate bench body such that said at least first and second elongate slides move in a substantially horizontal plane below a plane defined by said elongate bench body top surface; said at least first and second elongate slides being configured such that a user can sit on one of the at least first and second elongate slides and dangle legs over at least one of the elongate sides of one of the at least first and second elongate slides when a selected one of said at least first and second elongate slides is in its extended position.

6. The entry assistance system of claim 1 wherein said at least one elongate slide when in an extended position is configured to reach substantially across said paddle or oar powered watercraft adjacent to said dock in said positioning unit so that said user can sit on said at least one elongate slide when it is in its extended position to lower himself or herself into said paddle or oar powered watercraft.

7. The entry assistance system of claim 1 wherein said support member is fixed in a position spaced horizontally from said front surface of said elongate bench body when said at least one elongate slide is in its retracted position a distance no greater than a length of said at least one elongate slide.

8. The entry assistance system of claim 1 wherein said support member further comprises a first horizontal surface upon which said at least one elongate slide removably rests when said at least one elongate slide is in an extended position.

9. The entry assistance system of claim 1 further comprising an entrance/exit assist member located proximate one of said at least first and second guide rails; said entrance/exit assist member comprising a pair of opposed legs extending upwardly on opposite sides of said positioning unit, and a cross-member extending between said legs and over said positioning unit, said legs being of sufficient height such that said paddle or oar powered watercraft can pass under said cross-member, and whereby said cross-member is at a height to be reachable by a user sitting in said paddle or oar powered watercraft.

10. The entry assistance system of claim 1 wherein said at least first and second guide rails are spaced apart from each other a distance sufficient to allow said paddle or oar powered watercraft to pass therebetween, yet allow for a user to simultaneously grab the at least one grab bar of both said first and second guide rails.

11. The entry assistance system of claim 1 wherein said elongate bench further comprises a side edge member extending alongside said side edges of said seating portion at an upper edge of said seating portion; said side edge member defining a curved surface.

12. The entry assistance system of claim 11 wherein said side edge member comprises a tubular member.

* * * * *